US009955738B2

(12) United States Patent
Pillow

(10) Patent No.: US 9,955,738 B2
(45) Date of Patent: May 1, 2018

(54) ENHANCEMENT LEGWEAR WITH REMOVABLE PADS

(71) Applicant: Beverly Pillow, Duluth, GA (US)

(72) Inventor: Beverly Pillow, Duluth, GA (US)

( * ) Notice: Subject to any disclaimer, the term of this patent is extended or adjusted under 35 U.S.C. 154(b) by 206 days.

(21) Appl. No.: 13/965,787

(22) Filed: Aug. 13, 2013

(65) Prior Publication Data

US 2015/0047102 A1 Feb. 19, 2015

(51) Int. Cl.
*A41B 11/00* (2006.01)

(52) U.S. Cl.
CPC ..... *A41B 11/006* (2013.01); *A41B 2400/38* (2013.01)

(58) Field of Classification Search
CPC ..... A42B 11/006; A43B 17/00
USPC ..... 2/22, 239, 240
See application file for complete search history.

(56) References Cited

U.S. PATENT DOCUMENTS 2,501,903 A * 3/1950 Huggins ..... A61F 2/60 2/22
2,544,065 A * 3/1951 Carr ..... A63B 71/1225 2/22
3,216,223 A * 11/1965 Margulies ..... D04B 1/26 66/178 R
3,386,270 A * 6/1968 Simmons ..... A61F 13/08 2/240
4,001,953 A * 1/1977 Fugere ..... A63B 71/1225 2/22
4,306,315 A * 12/1981 Castiglia ..... A63B 71/1225 2/22
5,307,522 A * 5/1994 Throneburg ..... A41B 11/00 2/239
5,682,617 A * 11/1997 Tumas ..... A61F 13/08 2/239
5,784,721 A * 7/1998 Huff ..... 2/239
6,125,665 A * 10/2000 Lonati ..... D04B 1/26 2/239
6,298,484 B1 * 10/2001 Beckman ..... A63B 71/1225 2/22
6,385,778 B1 * 5/2002 Johnson ..... A41B 11/00 2/239
6,681,403 B2 * 1/2004 Lyden ..... A41D 13/0153 2/22
6,729,164 B2 * 5/2004 Shibata ..... 66/178 R
7,666,156 B2 * 2/2010 Brown ..... 602/23
8,540,654 B2 * 9/2013 Davis ..... A43B 7/146 601/149
8,726,422 B1 * 5/2014 Pirela ..... A41B 11/14 2/242
2003/0167548 A1 * 9/2003 LaShoto ..... A41D 13/015 2/22
2007/0022519 A1 * 2/2007 South ..... 2/239
2009/0235422 A1 * 9/2009 Lueking ..... 2/22
2012/0117706 A1 * 5/2012 Tateo ..... 2/24
2013/0333096 A1 * 12/2013 Song ..... 2/239

* cited by examiner

*Primary Examiner* — Richale Quinn
(74) *Attorney, Agent, or Firm* — Incorporating Innovation LLC; Charlena Thorpe, Esq.

(57) ABSTRACT

Legwear is provided having at least two interior pockets in the calf area and ankle area of the legwear for inserting pads to enhance the physical structure of a person's leg between the knee and the ankle.

6 Claims, 2 Drawing Sheets

ENHANCEMENT LEGWEAR WITH REMOVABLE PADS

TECHNICAL FIELD

This disclosure relates to implementations of enhancement legwear with removable pads.

BACKGROUND

It may be advantageous or desirable to enhance the natural physical structure of a person's leg between the knee and the ankle. For example, a person whose calves are too small for particular boots, may find it advantageous to enhance the legs in the calf area to achieve a proper boot fit and/or look. Otherwise, the boots may be too loose, uncomfortable, or fall down or improperly sag on the person's leg. As another example, a person whose legs around the ankle area are too small for particular boots, may find it advantageous to enhance the legs in the Achilles tendon/ankle area to achieve a proper boot fit and/or look. Otherwise, the boots (e.g., ankle boots) may appear too big.

As another example, leggings are an article of clothing designed to fit snuggly around a wearer's leg thereby exposing the shape of the wearer's leg. A person wearing legging may desire to enhance the appearance of his/her lower legs. Similarly, a person wearing socks with an outfit that exposes the socks and hence the shape of the wearer's legs, may find it desirable to enhance the appearance of his/her lower legs.

DETAILED DESCRIPTION

In some implementations of the present disclosure, legwear is provided having at least two interior pockets in a calf area and ankle/Achilles tendon area of the legwear for inserting pads to enhance the physical structure of the back of a person's lower legs when the legwear is worn.

In some implementations, the calf area of the legwear refers generally to a region of the back of the legwear coinciding with a part of an upper portion of the lower leg of a wearer when the legwear is worn, and the ankle/Achilles tendon area refers generally to a region of the back of the legwear coinciding with a part of a lower portion of the lower leg of a wearer when the legwear is worn.

In some implementations, the calf area of the legwear refers generally to a region of the back of the legwear coinciding with at least a portion of the calf of a wearer's leg when the legwear is worn.

In some implementations, the ankle area or Achilles tendon area of the legwear refers generally to a region of the back of the legwear coinciding with at least a portion of the Achilles tendon when the legwear is worn.

In some implementations, the ankle area or Achilles tendon area of the legwear refers generally to a region of the back of the legwear below the calf area of the legwear.

In some implementations of the present disclosure, the legwear has one interior pocket in either the calf area or ankle/Achilles tendon area of the legwear for inserting pads.

Legwear of the present disclosure can be any article designed to be worn directly on a portion of the legs including but not limited to stockings, socks, hosiery, and tights for example. Legwear of the present disclosure can be an undergarment or outer garment. Legwear of the present disclosure also can include footless articles for the legs including but not limited to leggings or footless hosiery, for example. Legwear of the present disclosure can be made of any material such as nylon, cotton, lycra, or spandex and can be any color.

In some implementations, the pocket in the calf area is larger than the pocket in the ankle area. Accordingly, in some implementations, the pad for the calf pocket may be larger than the pad for the ankle/Achilles tendon pocket. In some implementations, the pockets and pads are the same size for easy interchangeability. In some implementations, the pads can be any fabric-covered padding.

Figure 1:
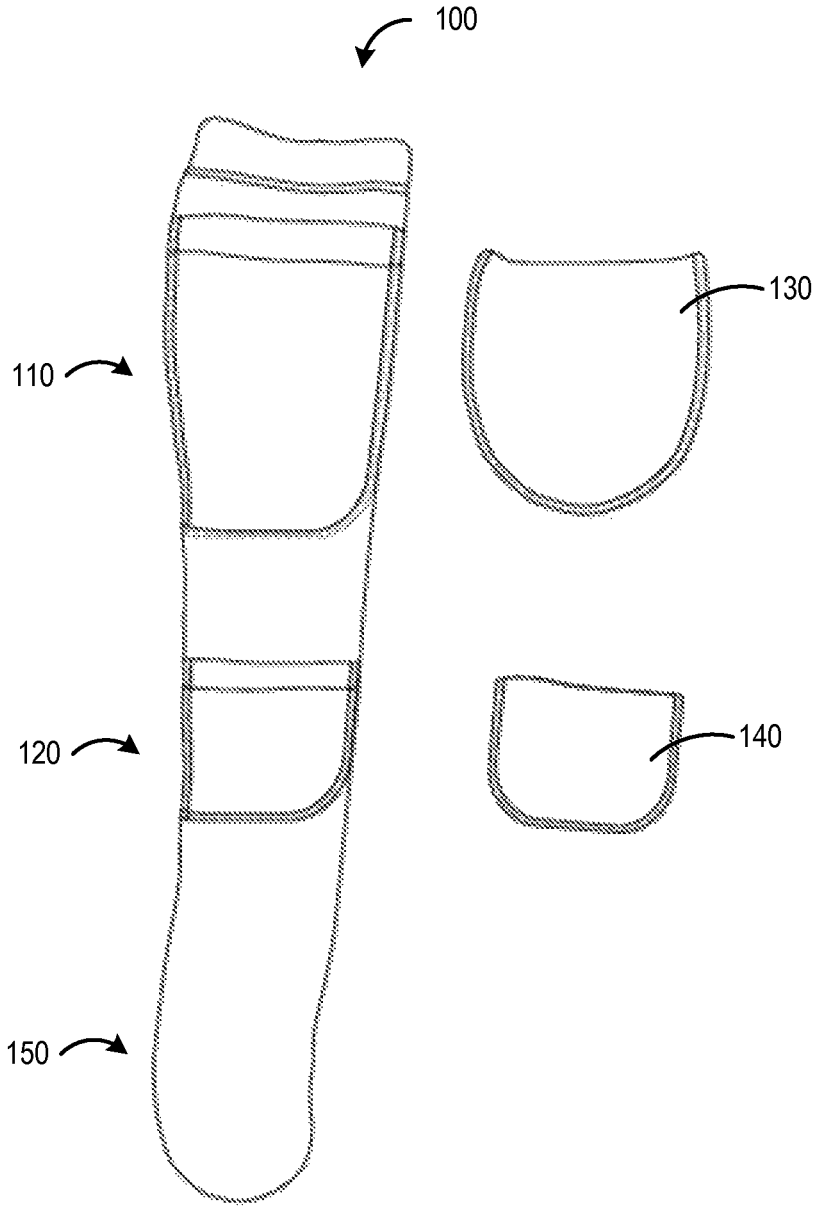
FIG. 1 illustrates an example legwear of the present disclosure.

FIG. 1 illustrates an example legwear 100 of the present disclosure. The legwear 100 is shown inside-out; thus, the interior of the legwear 100 is shown. Moreover the legwear 100 is shown with the foot portion 150 in a stretched-out position. The legwear 100 includes two pockets 110, 120 for inserting pads 130, 140, respectively.

In some implementations, the upper pocket 110 may be generally positioned in an area coinciding with a part of an upper portion of the lower leg of a wearer when the legwear is worn. In some implementations, the upper pocket 110 may be generally positioned in an area where an intended wearer's calf muscle may occupy when the wearer is wearing the legwear 100. In some implementations, the upper pocket 110 may be sized to coincide with a portion of the wearer's calf muscle when the wearer is wearing the legwear 100.

In some implementations, the length of the upper pocket 110 may be the average length of the calf muscle of the intended wearers of the legwear. In some implementations, the length of the upper pocket 110 may be longer or shorter than the average length of the calf muscle of the intended wearers of the legwear. In some implementations, the width of the upper pocket 110 may be about ½ the diameter of the legwear at the location of the upper pocket 110. In some implementations, the width of the upper pocket 110 may be smaller or larger.

In some implementations, the lower pocket 120 may be generally positioned in an area coinciding with a part of a lower portion of the lower leg of a wearer when the legwear is worn.

In some implementations, the lower pocket 120 may be generally positioned in an area where an intended wearer's Achilles tendon/ankle muscle may occupy when the wearer is wearing the legwear 100. In some implementations, the lower pocket 120 may be sized to coincide with a portion of the wearer's Achilles tendon/ankle muscle when the wearer is wearing the legwear 100. In some implementations, the length of the lower pocket 120 can be shorter or longer. In some implementations, the width of the lower pocket 120 may be about ½ the diameter of the legwear at the location of the lower pocket 120. In some implementations, the width of the lower pocket 120 may be smaller or larger.

In some implementations, the lower pocket 120 may be generally positioned below the upper pocket 110.

In some implementation, the upper 110 and lower 120 pockets may be generally positioned in any area between where a knee and ankle of a wearer may occupy when the legwear 100 is worn on a leg where the lower pocket 120 is positioned below the upper pocket 110.

Figure 2B:
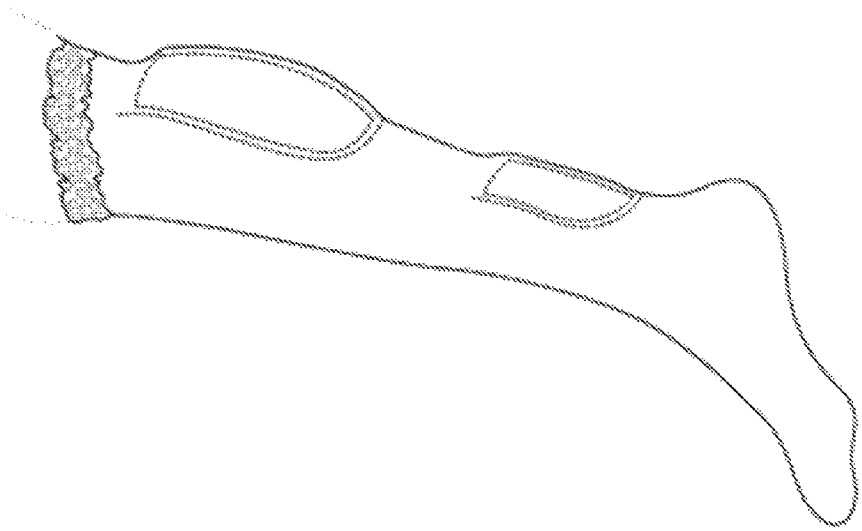
FIG. 2B illustrate the use of the legwear of the present disclosure to enhance the physical structure of a person's lower legs.
Figure 2A:
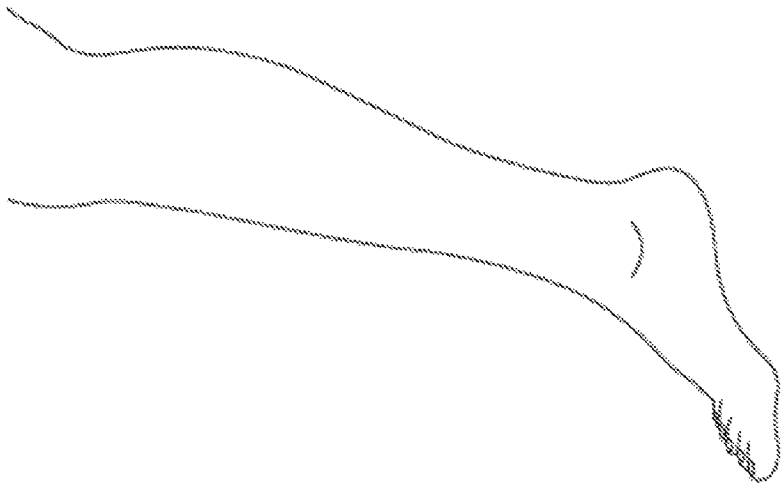
FIG. 2A illustrates an example natural physical structure of a person's lower leg.

FIG. 2A illustrates an example natural physical structure of a person's lower leg. FIG. 2B illustrates the use of the legwear of the present disclosure to enhance the physical structure of a person's lower legs. Thus, a wearer having calves too small for particular boots, may use the legwear of the present invention to enhance the legs in the calf area to achieve a proper boot fit. Similarly, a wearer having ankles too small for particular boots, may use the legwear of the present invention to enhance the legs in the Achilles tendon/ankle area to achieve a proper boot fit.

A wearer of the legwear of FIG. 2B may insert one or more pads in the upper pocket and leave the lower pocket empty. In an alternative arrangement, the wearer may insert one or more pads in the lower pocket and leave the upper pocket empty. In another alternative arrangement, the wearer may insert one or more pads in the upper pocket and one or more pads in the lower pocket.

Although FIG. 2A and FIG. 2B illustrate a thigh high construction, the legwear of the present disclosure can be any legwear.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. An article of manufacture comprising:

a material configured to form a leg article to be worn on at least a portion of a leg wherein the leg article comprises an elongated portion having an opening therethrough wherein the opening is configured to receive a wearer's foot and leg such that when the leg article is placed on a wearer's leg, the elongated portion is sized to extend between the wearer's knee and ankle, wherein the elongated portion further comprises a front portion having an exterior surface and interior surface and a back portion having an exterior surface and interior surface, such that when the leg article is placed on a wearer's leg, the front portion covers at least a portion of the front portion of the user's leg and the back portion covers at least a portion of the back portion of the user's leg, wherein the front portion of the elongated portion consists of a portion of the material; and wherein the interior portion of the back portion of the elongated portion comprises a first pocket and a second pocket wherein each pocket comprises an opening for receiving a pad and wherein the first pocket is sized and positioned to cover an upper portion of the interior portion of the back portion of the elongated portion and the second pocket is sized and positioned to extend from and cover a lower portion of the interior portion of the back portion of the elongated portion such that when the article is placed on an wearer's leg the first pocket coincides with a part of an upper portion of the lower leg of a wearer and the second pocket coincides with a part of a lower portion of the lower leg of a wearer wherein the article further comprises a first and second pad configured to be inserted into the first pocket and second pocket respectively wherein the first pad and second pad consist of soft material.

2. The article of claim 1 wherein the material forming the elongated portion comprises spandex configured to extend from below the wearer's knee to the wearer's ankle.

3. The article of claim 2 wherein the leg article is a knee high.

4. The article of claim 1 wherein the part of an upper portion of the lower leg is at least a portion of the calf and the part of a lower portion of the lower leg is at least a portion of the Achilles tendon.

5. The article of claim 1 wherein the leg article further comprises a distal portion extending from the elongated portion and configured to cover at least a portion of the foot.

6. The article of claim 1 wherein the leg article is footless.

* * * * *